US008240532B2

(12) United States Patent
Cragg

(10) Patent No.: US 8,240,532 B2
(45) Date of Patent: Aug. 14, 2012

(54) CONCEALED MAGAZINE SLOT ARRANGEMENT FOR CHEST HARNESS, MIDRIFF HARNESS, VEST, OR THE LIKE

(75) Inventor: James Victor Cragg, Carson, CA (US)

(73) Assignee: S.O. Tech Special Operations Technology, Inc., Carson, CA (US)

( * ) Notice: Subject to any disclaimer, the term of this patent is extended or adjusted under 35 U.S.C. 154(b) by 1029 days.

(21) Appl. No.: 12/157,877

(22) Filed: Jun. 13, 2008

(65) Prior Publication Data

US 2008/0257929 A1 Oct. 23, 2008

Related U.S. Application Data

(63) Continuation-in-part of application No. 10/694,233, filed on Oct. 27, 2003, now Pat. No. 7,458,491.

(60) Provisional application No. 60/508,417, filed on Oct. 3, 2003.

(51) Int. Cl.
*A45F 3/04* (2006.01)

(52) U.S. Cl. ..... 224/648; 224/654; 224/931; 224/651; 224/653

(58) Field of Classification Search ..... 224/196, 224/623, 645, 676, 680, 681, 682, 683, 684, 224/242, 250, 675, 625, 626, 637, 646, 648, 224/235, 240, 259, 262, 654, 931, 651, 653; D3/262

See application file for complete search history.

(56) References Cited

U.S. PATENT DOCUMENTS

| | | | | |
|---|---|---|---|---|
| 1,290,827 | A | 1/1919 | Yergason | |
| 1,340,077 | A | 5/1920 | Orr | |
| 1,340,142 | A | 5/1920 | Batchelder | |
| 3,968,522 | A | 7/1976 | Riess | |
| 5,505,356 | A | 4/1996 | Noriega et al. | |
| 5,517,696 | A | 5/1996 | Krugler | |
| D382,110 | S * | 8/1997 | Pollari | D3/217 |
| 5,829,060 | A | 11/1998 | Falk et al. | |
| 6,131,198 | A | 10/2000 | Westrick | |
| 6,135,333 | A | 10/2000 | Tucker et al. | |
| 6,402,002 | B1 | 6/2002 | Benton | |
| 6,412,674 | B1 * | 7/2002 | Lipke | 224/240 |
| 6,561,402 | B2 | 5/2003 | Holland et al. | |
| 6,662,373 | B2 | 12/2003 | Frank | |
| 7,364,057 | B2 * | 4/2008 | Carroll | 224/196 |
| 7,780,048 | B2 * | 8/2010 | Howell | 224/242 |
| 7,963,427 | B2 * | 6/2011 | Calkin | 224/675 |
| 2002/0014507 | A1 | 2/2002 | Snider et al. | |
| 2002/0145027 | A1 | 10/2002 | Godshaw et al. | |

* cited by examiner

*Primary Examiner* — Justin Larson
(74) *Attorney, Agent, or Firm* — Cislo & Thomas, LLP

(57) ABSTRACT

A concealed magazine slot arrangement includes a magazine holder, a gear carrier, and a fastening device for fastening the magazine holder on the user's body. The magazine holder includes an inner panel, an outer panel, having a front operation side, overlapped thereon, and a plurality of slot dividers affixed between the inner and outer panels to form a plurality of magazine slots concealed within the inner panel, the outer panel, and the slot dividers for receiving the magazine. A gear carrier is provided on the front operation side of the magazine holder for carrying a gear thereon. Quick accessing fasteners facilitate securing magazines in magazine slots. Means for adjusting the depth of the magazine slots are provided.

6 Claims, 10 Drawing Sheets

CONCEALED MAGAZINE SLOT ARRANGEMENT FOR CHEST HARNESS, MIDRIFF HARNESS, VEST, OR THE LIKE

CROSS REFERENCE OF RELATED APPLICATION

This patent application is a continuation-in-part application of U.S. patent application Ser. No. 10/694,233, filed on Oct. 27, 2003, now U.S. Pat. No. 7,458,491, which claims the benefit of U.S. Provisional Patent Application No. 60/508,417, filed Oct. 3, 2003.

TECHNICAL FIELD

The present invention relates to a military gear, and more particularly to a concealed magazine slot arrangement for chest harness, midriff harness, vest, or the like, wherein the concealed magazine slot arrangement comprises a magazine holder having a plurality of magazine slots alignedly formed in a concealed manner such that the magazine holder provides a front operation side for holding other gears thereon.

BACKGROUND OF THE PRESENT INVENTION

Loaded magazines are often utilized during combat situations. Various magazine carriers are develop to carry the loaded magazines on the user's body such that the user is able to conveniently transport and store the loaded magazines as the spare magazines during combat situation. Accordingly, the magazine carrier not only securely and safety accommodates the loaded magazine especially during the movement of the user but also provides a quick release and access of the loaded magazine. Therefore, most magazine carriers are incorporated with a vest or other garment worn by the user such that the user is able to reach the magazine carrier for easily accessing the loaded magazines.

A typical magazine carrier comprises a fastening pad adapted for wearing on the user's body, and a plurality of magazine pouches formed on the front side of the fastening pad for holding the loaded magazines respectively. Therefore, when the user wears the magazine carrier, the user is able to easily reach the magazine pouches and quickly access the loaded magazines therein. However, such magazine carrier has several drawbacks.

The magazine carrier is mainly designed only for carrying the magazines such that other gears must utilize other carrying devices. However, since the front side of the fastening pad is occupied by the magazine pouches, the carrying devices must be carried at other locations on the user's body. It is worth to mentioning that when numerous of carrying devices are held on the user's body, the mobility of the user will substantially reduced. Therefore, no alternative usage of the conventional magazine carrier can be provided.

In addition, the magazine carrier can only carry a predetermined number of magazines therein such that when all the magazines are used up, the magazine carrier becomes an extra burden gear on the user's body. In other words, when the user needs to carry more magazines, an additional magazine carrier must be carried on the user's body.

Furthermore, the magazine must be securely held within the magazine pouch especially during movement of the user while maintaining quick releaseability from the magazine pouch for use. Failure to quickly access the magazine during a combat situation may cause injury or death. However, it is a conflict between the quick access and the secure retention of the magazine in the magazine pouch.

DISCLOSURE OF INVENTION

A main object of the present invention is to provide a concealed magazine slot arrangement for chest harness, midriff harness, vest, or the like, wherein the concealed magazine slot arrangement comprises a magazine holder having a plurality of magazine slots alignedly formed in a concealed manner such that the magazine holder provides a front operation side for holding other gears thereon.

Another object of the present invention is to provide a concealed magazine slot arrangement which can be quickly and easily carried at the chest or midriff of the user.

In addition, the concealed magazine slot arrangement can be constructed as a vest that the user is able to wear for carrying the magazines.

Another object of the present invention is to provide a concealed magazine slot arrangement, wherein the magazine holder comprises an inner panel and an outer panel overlapped thereon to form the magazine slots between the inner and outer panels in a concealed manner, such that the front operation side of the outer panel can be utilized for holding other gears thereon.

Another object of the present invention is to provide a concealed magazine slot arrangement, wherein when the user wears the magazine holder, the inner and outer panels are bent to fit the curvature of the user's body, such that the magazines held within the magazine slots are securely retained by the physical curvature of the user's body.

Another object of the present invention is to provide a concealed magazine slot arrangement which further comprises a quick accessing fastener to not only provide a secure retention of the magazine within the respective magazine slot but also provide a rapid and easy access and withdrawal of the magazine from the magazine slot.

Another object of the present invention is to provide a concealed magazine slot arrangement, wherein an additional magazine carrier can be detachably fastened with the concealed magazine slot arrangement so as to substantially increase the numbers of magazines carried by the user without reducing the mobility of the user.

Accordingly, in order to accomplish the above objects, the present invention provides a concealed magazine slot arrangement for carrying at least a magazine on a user's body, comprising: a magazine holder comprising an inner panel, an outer panel, having a front operation side, overlapped on the inner panel, and a plurality of slot dividers transversely and spacedly affixed between the inner and outer panels to form a plurality of magazine slots concealed within the inner panel, the outer panel, and the slot dividers for receiving the magazine; a gear carrier provided on the front operation side of the magazine holder for carrying a gear thereon; and means for detachably fastening the magazine holder on the user's body, wherein the magazine holder is warped for fitting a curvature of the user's body, such that the outer panel is reinforced to substantially bias against the inner panel to physically self-adjust a shape of the magazine slots for retaining the magazine within the respective magazine slot of the magazine holder.

These and other objectives, features, and advantages of the present invention will become apparent from the following detailed description, the accompanying drawings, and the appended claims.

MODES FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
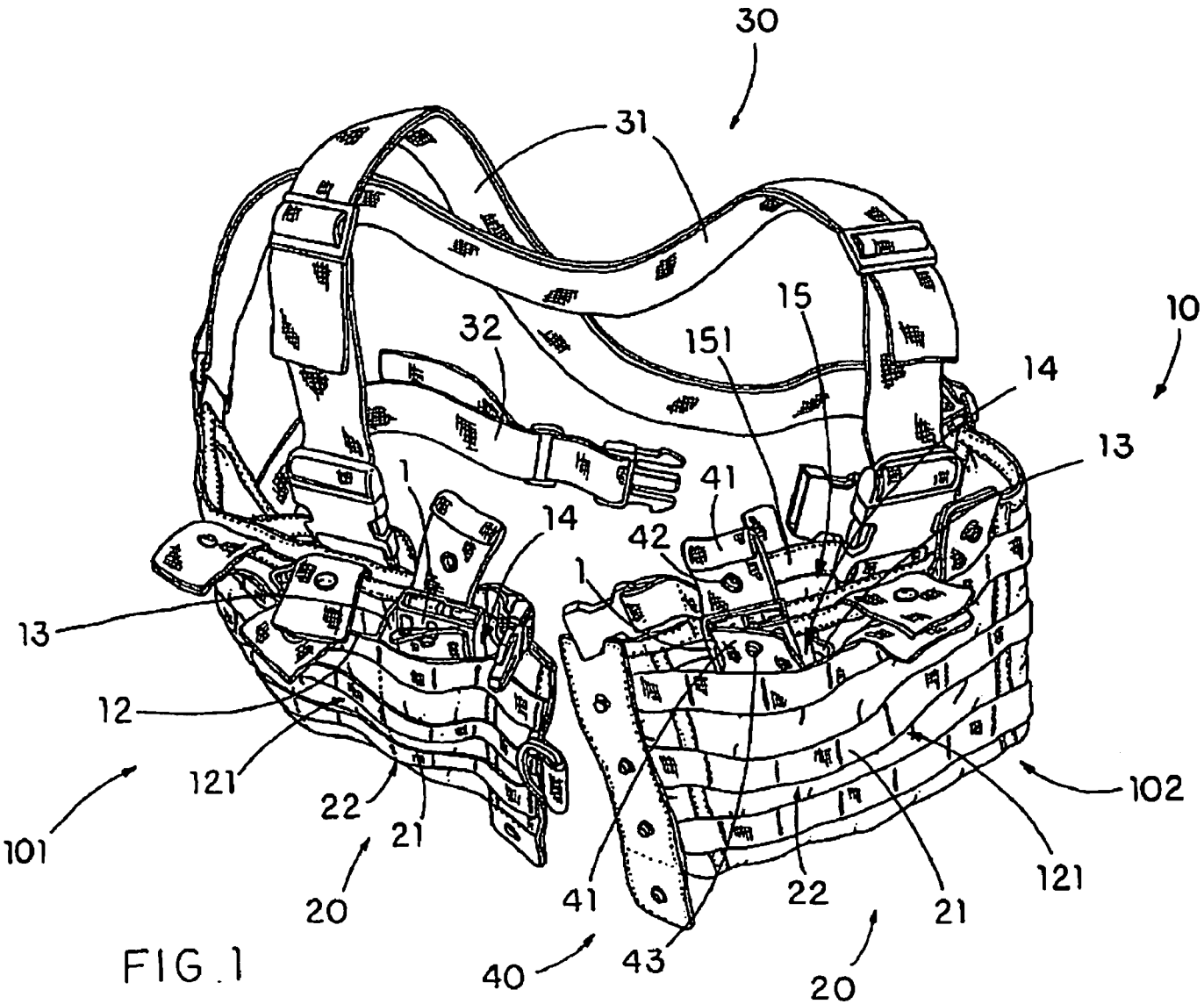
FIG. 1 is a perspective view of a concealed magazine slot arrangement according to a preferred embodiment of the present invention.
Figure 2:
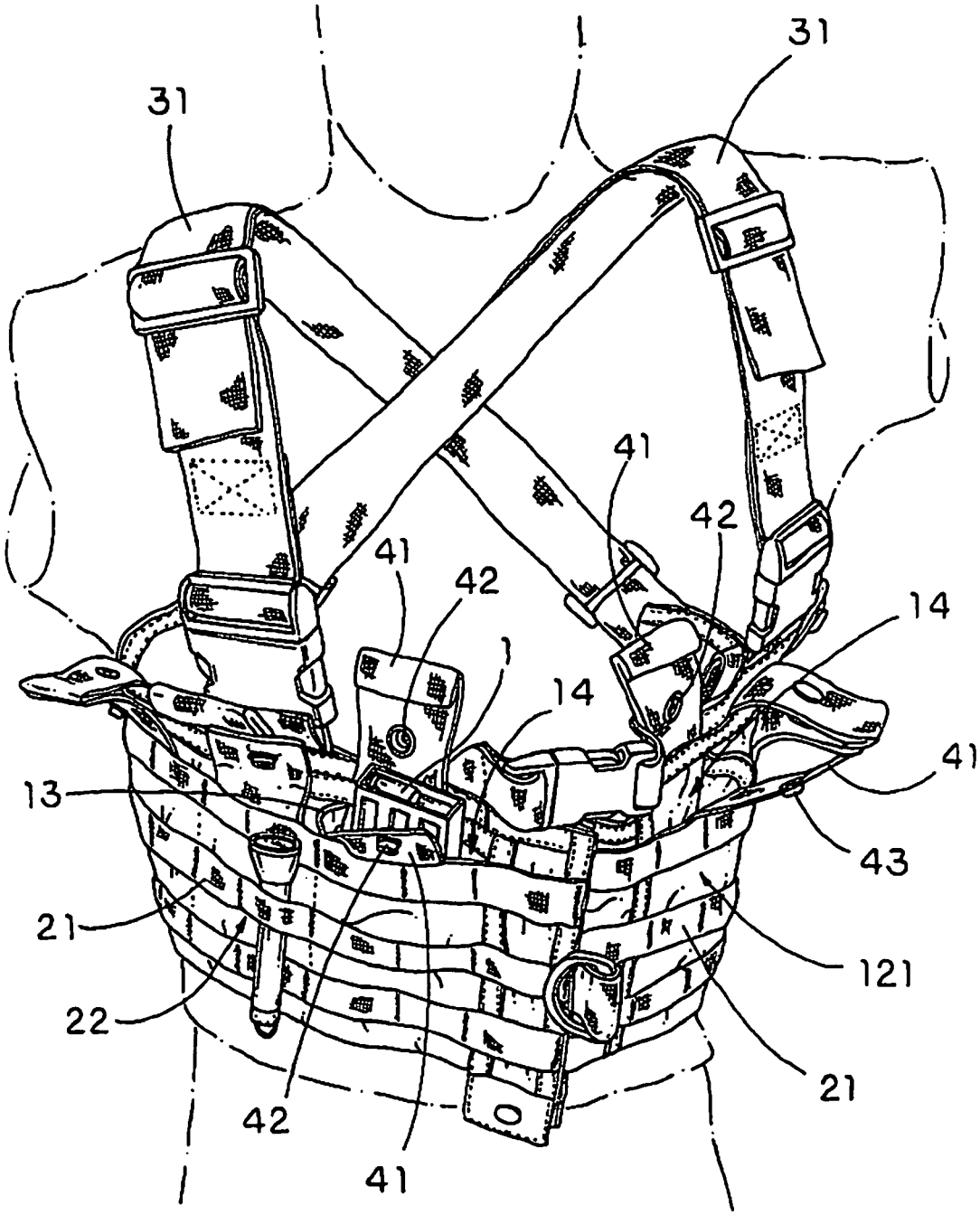
FIG. 2 is a perspective view of the concealed magazine slot arrangement as a vest worn on the user according to the above preferred embodiment of the present invention.

Referring to FIGS. 1 and 2 of the drawings, a concealed magazine slot arrangement according to a preferred embodiment of the present invention is illustrated, wherein the concealed magazine slot arrangement is adapted for carrying at least a magazine 1 on a user's body.

The concealed magazine slot arrangement comprises a magazine holder 10 comprising an inner panel 11, an outer panel 12, having a front operation side 121, overlapped on the inner panel 11, and a plurality of slot dividers 13 transversely and spacedly affixed between the inner and outer panels 11, 12 to form a plurality of magazine slots 14 concealed within the inner panel 11, the outer panel 12, and the slot dividers 13 for receiving the magazine 1.

The concealed magazine slot arrangement further comprises a gear carrier 20 provided on the front operation side 121 of the magazine holder 10 for carrying a gear thereon, and means 30 for detachably fastening the magazine holder 10 on the user's body, wherein the magazine holder 10 is warped for fitting a curvature of the user's body, such that the outer panel 12 is reinforced to substantially bias against the inner panel 11 to physically self-adjust a shape of the magazine slots 14 for retaining the magazine 1 within the respective magazine slot 14 of the magazine holder 10.

According to the preferred embodiment, the magazine holder 10 is made of durable fabric such as nylon such that the magazine holder 10 is adapted to be wrapped to fit the curvature of the user's body. The outer panel 12 is overlappedly attached to the inner panel 11 to form an opening of each of the magazine slots 14. Each of the slot dividers 13 has two transverse edges securely affixed to an outer side of the inner panel 11 and an inner side of the outer panel 12 respectively to form the magazine slot 14 within each two slot dividers 13, the inner panel 11, and the outer panel 12. The magazine slots 14 are concealed between the inner and outer panel 12 such that the magazine 1 can be concealed in the magazine holder 10. In some embodiments, the slot dividers 13 may simply be an extension of the outer panel 12.

Due to the physical structure of the magazine holder 10, the magazine holder 10 allows the front operation side 121 to be utilized. As shown in FIG. 1, the gear carrier 20 is provided on the front operation side 121 of the magazine holder 10 for carrying a gear thereon. The gear carrier 20 comprises a plurality of webbing straps 21 longitudinally formed on the front operation side 121 of the magazine holder 10 wherein each of the webbing straps 21 is spacedly sewn or otherwise affixed on the front operation side 121 of the magazine holder 10 to form a plurality of gear slots 22 for slidably receiving the gear therethrough. Accordingly, the gear such as flash light can be slid through the gear slot 22 so as to hold the gear on the front operation side 121 of the magazine holder 10. An additional magazine holder can be held on the front operation side 121 of the magazine holder 10 via the gear carrier 20 so as to substantially increase the number of magazines 1 on the user's body.

The fastening means 30 comprises a shoulder strap 31 upwardly extended from the magazine holder 10 and a waist strap 32 sidewardly extended from the magazine holder 10 such that the magazine holder 10 serves as a vest for being worn on the user's body while the magazine slots 14 are positioned at the chest of the user. When the user wears the magazine holder 10 via the fastening means 30, the inner and outer panels 11, 12 of the magazine holder 10 may be self-adjustably wrapped to fit the curvature of the user's body such that the outer panel 12 is physically bent to apply holding force against the magazines 1 within the magazine slots 14 respectively so as to reinforce the magazine 1 in the respective magazine slot 14 in position.

In comparison with the conventional magazine carrier, the magazine pockets are formed on the front side of the magazine carrier such that when the magazine is received in the magazine pocket, an unwanted movement of the magazine is created within the magazine pocket during the movement of the user. It is a burden for the user when the magazines shift around in the magazine pockets, especially during combat situation. However, the concealed magazine slot arrangement of the present invention minimizes the magazines 1 movement in the magazine slots 14 during the movement of the user. In addition, the magazines 1 are tightly positioned close to the user's body so as to enhance the mobility of the user while carrying the magazines 1.

As shown in FIG. 1, since the magazine holder 10 serves as a vest for being worn on the user's body, the magazine holder 10 may be constructed to have two side portions 101, 102 detachably affixing with each other edge to edge to form a front opening 103 between the two side portions 101, 102, wherein the magazine slots 14 are respectively formed at the side portions 101, 102 of the magazine holder 10. Therefore, the user is able to easily wear the concealed magazine slot arrangement of the present invention as an ordinary vest. In some embodiments, side portions 101, 102 may be continuous through the front and magazine holder may be slipped on like a shirt.

Figure 3C:
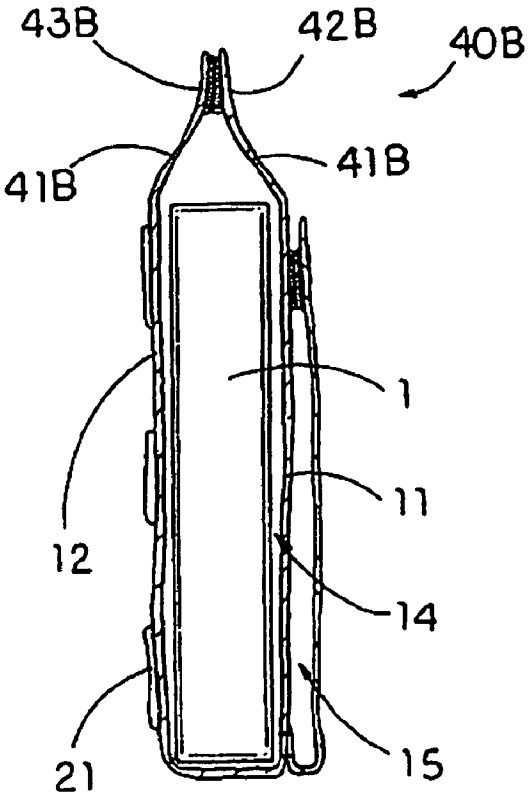
FIGS. 3A through 3I are sectional views of the concealed magazine slot arrangement and the alternative modes of the quick accessing fastener of the concealed magazine slot arrangement according to the above preferred embodiment of the present invention.

The concealed magazine slot arrangement further comprises a quick accessing fastener 40 for securely retaining the magazine 1 within the respective magazine slot 14 and for providing a quick access to the magazine 1 to withdraw from the respective magazine slot 14. As shown in FIGS. 1 and 3A, the quick accessing fastener 40 comprises two elongated straps 41 extended from the inner panel 11 and the outer panel 12 respectively at an opening of each of the magazine slots 14, and first and second fasteners 42, 43 respectively formed at the two elongated straps 41, wherein the first fastener 42 is detachably fastened with the second fastener 43 to enclose the respective magazine slot 14 for securely holding the magazine 1 therein. Therefore, the user is able to simply detach the first fastener 42 from the second fastener 43 such that the user can rapidly and easily access the magazine 1 in the magazine slot 14 while the magazine 1 is still retain by the curvature of the user's body. Accordingly, the first and second fasteners 42, 43 are preferably snap buttons.

Figure 3B:
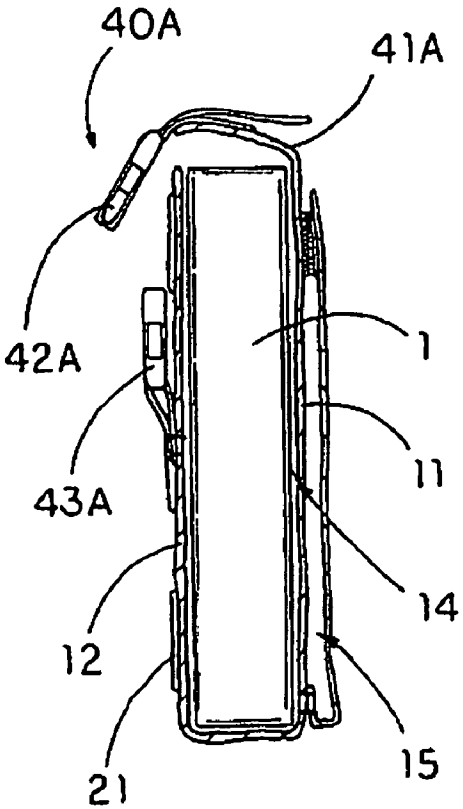
Figure 3A:
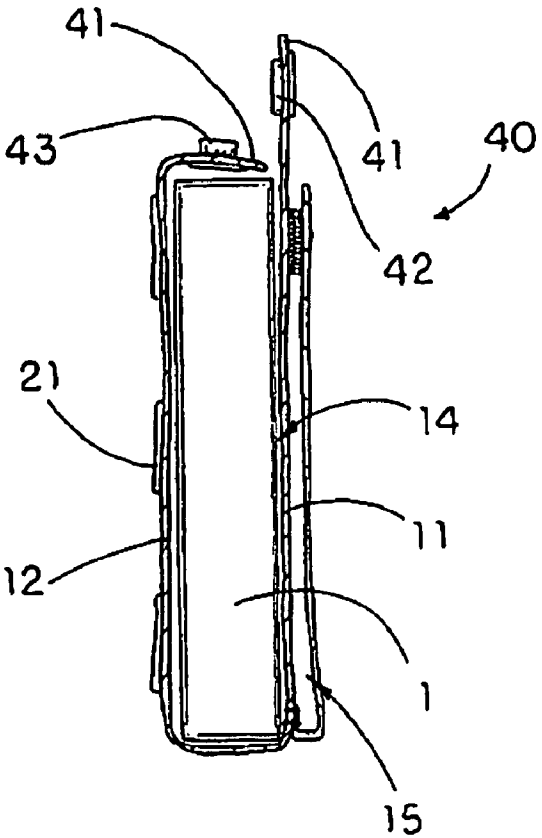

Alternatively, the quick accessing fastener 40A comprises a shielding strap 41A extended from the inner panel 11 of the magazine holder 10 and first and second fasteners 42A, 43A respectively formed on the shielding strap 41A on the front operation side 121 of the outer panel 12, as shown in FIG. 3B, wherein the first fastener 42A is detachably fastened with the second fastener 43A to enclose the respective magazine slot 14 by the shielding strap 41A for securely holding the magazine 1 therein. Accordingly, the first and second fasteners 42A, 43A are preferably a buckle plug and a buckle socket respectively.

It is worth to mention that the first and second fasteners 42A, 43A can be a pair of snap fasteners, as shown in FIG. 1, wherein an additional second fastener can be provided on the front operation side 121 of the outer panel 12 such that the first fastener 42A can be selectively fastened with either the second fastener 43A or the addition second fastener to adjust a height of the magazine slot 14 for fitting the magazines 1 having various sizes.

FIG. 3C illustrates another alternative mode of the quick accessing fastener 40B which comprises two elongated straps 41B extended from the inner panel 11 and the outer panel 12, respectively, at an opening of each of the magazine slots 14, and first and second fasteners 42B, 43B respectively formed at the two elongated straps 41B wherein the first fasteners 42B is detachably fastened with the second fastener 43B to enclose the respective magazine slot 14 for securely holding the magazine 1 therein. Accordingly, the first and second fasteners 42B, 43B are hook and loop fasteners.

Figure 3D:
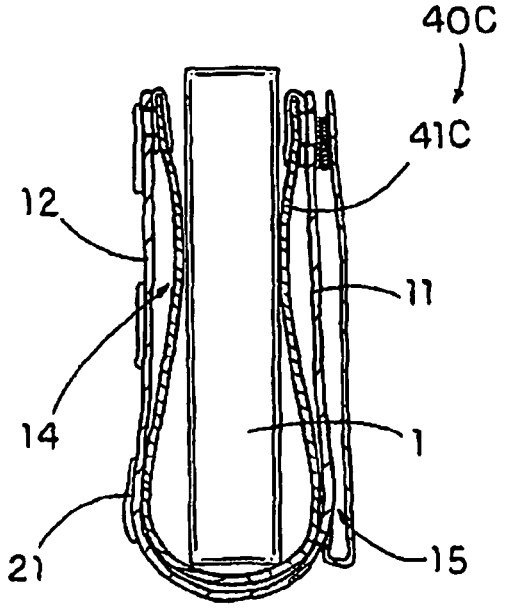

FIG. 3D illustrates another alternative mode of the quick accessing fastener 40C which comprises an elastic tension clip 41C securely disposed in each of the magazine slots 14 for applying an elastic clipping force on the magazine 1 when the magazine 1 is received in the respective magazine slot 14. However, the user is able to rapidly slide out the magazine 1 from the magazine slot 14 by pulling out the magazine 1 from the tension clip 41C.

Figure 3E:
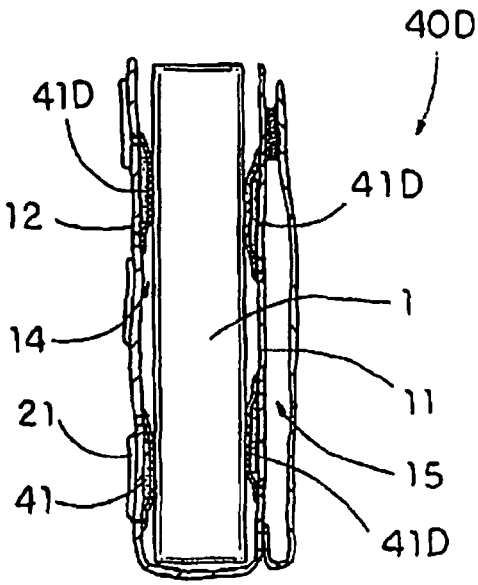

Another alternative mode of the quick accessing fastener 40D is shown in FIG. 3E, wherein the quick accessing fastener 40D comprises at least two magnetic members 41 D respectively formed on the inner and outer panels 11, 12 of the magazine holder 10 within each of the magazine slots 14 for magnetically attaching the magazine 1 so as to hold the magazine 1 within the magazine slot 14. It is worth to mention that since the magazine 1 is usually made of material having magnetic attraction ability such that when the magazine 1 is received in the respective magazine slot 14, the magnetic members 41D magnetically attaches with the magazine 1 to hold the magazine 1 in position while the user is able to rapidly withdraw the magazine 1 from the magazine slot 14. Accordingly, the magnetic members 41D are at least one magnet, respectively, embedded on the inner and outer panels 11, 12 of the magazine holder 10 within each of the magazine slots 14.

Figure 3F:
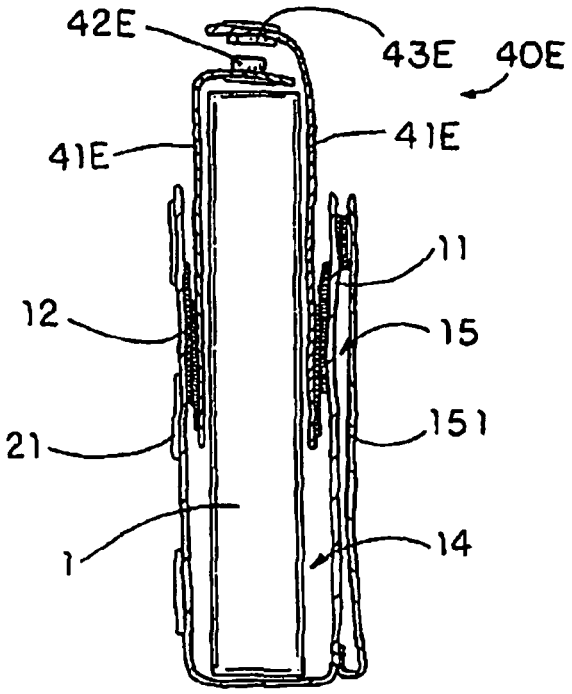

To further improve the versatility of the concealed magazine slot arrangement, quick accessing fasteners are designed with a means for adjusting the height or depth of the magazine slot. FIG. 3F illustrates an adjustable quick accessing fastener 40E which comprises two pouch flaps 41E detachably and adjustably attached to the inner and outer panels 11, 12 respectively within the magazine slot 14 and first and second fasteners 42E, 43E respectively formed at the two pouch straps 41E wherein the first fasteners 42E is detachably fastened with the second fastener 43E to enclose the respective magazine slot 14 for securely holding the magazine 1 therein.

As shown in FIG. 3F, two lower portions of the pouch flaps 41E are detachably attached to the inner and outer panels 11, 12 via two pairs of hook and loop fasteners respectively, wherein the first and second fasteners 42E, 43E are provided at two upper portions of the pouch flaps 41E in such a manner that the pouch flaps 41E are adapted to selectively attached to the inner and outer panels 11, 12 to provide a means for adjusting a height or depth of the respective magazine slot 14 for fitting magazines 1 of various sizes therewithin. Accordingly, the first and second fasteners 42E, 43E are also a pair of hook and loop fasteners.

Figure 3G:
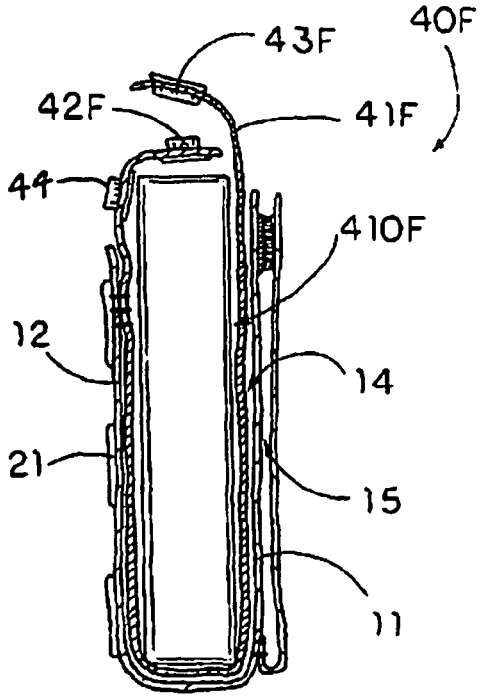

A further modification of the quick accessing fastener 40F is shown in FIG. 3G. The quick accessing fastener 40F comprises an elongated pouch flap 41F overlappedly folded in the respective magazine slot 14 to form a pouch cavity 410F within the magazine slot 14 for holding the magazine 1 therein, wherein two end portions of the pouch flap 41F are extended out of the magazine slot 14 and a portion of the pouch flap 41F is affixed to an upper edge of the magazine slot 14 in such a manner that when one of the corresponding end portions of the pouch flap 41F is pulled outwardly, the pouch flap 41F is slid out from the magazine slot 14 for extracting the magazine 1 from the pouch cavity 410F. Since a portion of the pouch flap 41F is affixed to the outer panel 12 at the upper edge of the magazine slot 14 by sewing, the pouch flap 41F cannot be entirely pulled out from the magazine slot 14 while the magazine 1 can be quickly and easily extracted from the pouch cavity 410F within the magazine slot 14.

Figure 3H:
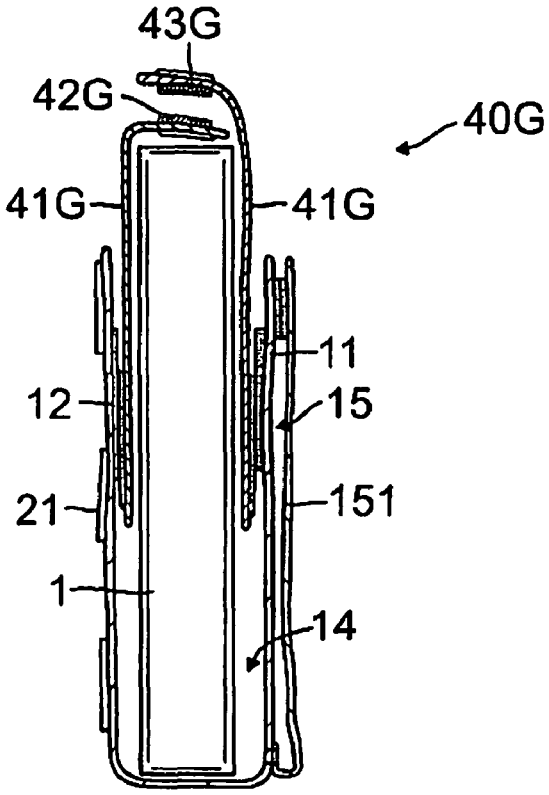

As shown in FIG. 3G, the quick accessing fastener 40F further comprises first and second fasteners 42F, 43F, respectively, provided at the two end portions of the pouch flap 41F wherein the first and second fasteners 42F, 43F are detachably fastened with each other to enclose the pouch cavity 410F for securely holding the magazine 1 therein. Accordingly, the first and second fasteners 42F, 43F may be a pair of snap fasteners or hook and loop fasteners 42F, 43G, as shown in FIG. 3H. An additional second fastener 44F may be formed on the respective end portion of the pouch flap 41F to align with the second fastener 43F such that the first fastener 43F is selectively fastened with one of the second fasteners 43F, 44F to adjust a height or depth of the pouch cavity 410F for fitting the magazine 1 therein.

Figure 3I:
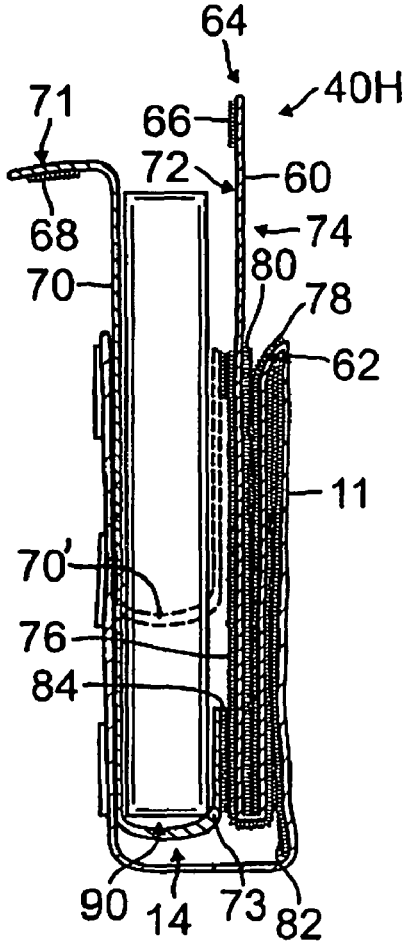

FIG. 3I shows another embodiment of the quick accessing fastener 40H with another means for adjusting the height or depth of the magazine slot 14. The quick accessing fastener 40H comprises a first pouch flap 60 having a tethered end 62 fixedly connected to the inner panel 11 and a first free end 64 having a first fastener 66 to fasten to a second fastener 68 on a second free 71 end of a second pouch flap 70. The first pouch flap 60 has a first side 72 and a second side 74. The first side 72 has a third fastener 76 adjacent to or continuous with the first fastener 66 and extending to the tethered end 62. The second side 74 has a fourth fastener 78 near the tethered end and a fifth fastener 80 adjacent to the free end. In addition, the inner panel 11 has a sixth fastener 82 capable of fastening to the third fastener 76. Thus, the first pouch flap 60 can be pushed into the magazine slot 14 to fasten the third fastener 76 of the first pouch flap 60 to the inner panel 11. The first pouch flap 60 can then be overlappedly folded back onto itself such that the fourth fastener 78 and the fifth fastener 80 mate with each other. This leaves a portion of the third fastener available and exposed to the inside of the magazine slot 14. The second pouch flap 70 has a third free end 73 opposite the second free end 71, the third free end 73 having a seventh fastener 84 to fasten to the third fastener 76. The seventh fastener 84 can fasten to any level on the third fastener 76 to create an inner magazine slot 14 (i.e. a magazine slot within the magazine slot). Due to the detachable fastening of the second flap 70 to the first flap 60, the depth of the inner magazine slot 90 is adjustable. Thus, the second flap 70 may be attached to first flap 60 at the bottom to form a deep inner magazine slot 90, the second flap 70' may be attached to the first flap 60 at the opening to form a shallow inner magazine slot 90, or the second flap may be attached anywhere there between to form an intermediate depth inner magazine slot 90. In addition, if a magazine or other equipment was placed too deep inside the inner magazine slot 90, the magazine or equipment can be easily removed by pulling the first free end 64 of the first pouch flap 60 to pull out the entire inner magazine slot 90. The inner magazine slot 90 can later be shoved back into position.

Although third, fourth, fifth and sixth fasteners 76, 78, 80, and 82, respectively, are each shown as a continuous strip, in some embodiments, these fasteners may be broken up into discrete patches at strategic locations to maintain versatility for adjusting the depth of the inner magazine slot 90, and weaken the connection so as to facilitate removal of the inner magazine slot 90 from the magazine slot 14.

Figure 5:
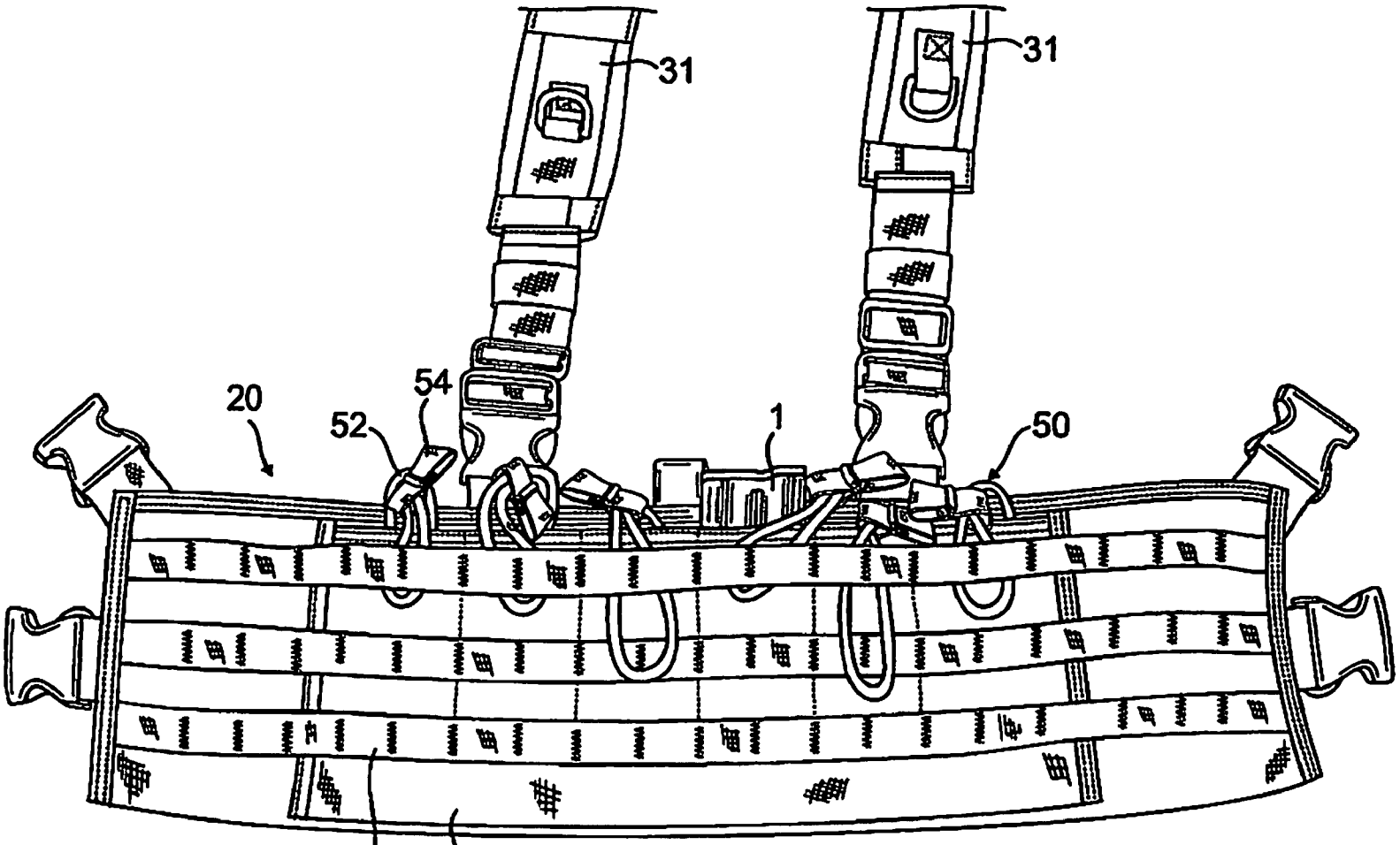
FIG. 5 is a front view of another embodiment of the concealed magazine slot arrangement.

FIG. 5 illustrates another mode of the quick accessing fastener 50 which comprises an elastic band 52 attached to the inner panel 11 and outer panel 12 at an opening of each of said magazine slots 14 for securely holding said magazine therein such that the elastic band 52 loops over the magazine slot 14. The elastic band 52 is configured so as to be taut when a magazine 1 is inserted into the magazine slot 14 and the elastic band 52 loops over the magazine 1, thereby applying a biasing force on the magazine 1 against the magazine slot 14. The elastic band 52 may further comprise a holding tab 54. The holding tab 54 is a strap wrapped around the elastic band 52 that can be easily grasped and pulled to adjust the elastic band 52.

In some embodiments, the elastic band 52 is a closed elastic loop that is movably or fixedly secured to the inner panel 11 and movably secured to the outer panel 12 for securely holding the magazine 1 therein. A first portion 600 of the elastic loop is trapped between two adjacent gear slots 22 of the webbing strap 21 and a second portion 700 of the closed elastic loop is trapped between two adjacent loop slots 702 along the inner panel 11 of the magazine holder 10 wherein the loop slots 702 are formed from spacedly sewing a top portion of the inner panel 11 to a back strap 704. A holding tab 54 may be wrapped around the elastic loop 52 to bundle the loop 52 together effectively creating a figure "8" with the elastic loop 52 with one end of the "8" secured around the gear slots 22 and the other end of the "8" secured around the loop slots 702.

Alternatively, the loop slots 702 may be formed from any material extending laterally across the top of the magazine holder 10 and being spacedly sewn to the magazine holder 10. The loop slots 702 are, thereby, formed between two adjacent sewn portions. The sewn portions can serve as an anchor point to trap the closed elastic loop 52 within the loop slots 702. This configuration attaches the closed elastic loop 52 to the magazine holder 10 while still allowing the elastic loop 52 to move, thereby, effectively creating an adjustable cover to the magazine holder 10 to accommodate magazines 1 of different sizes or magazines 1 in different positions within the magazine holder 10. In another embodiment, the second portion 700 of the elastic band may be fixedly attached to the inner panel 11.

Figure 6:
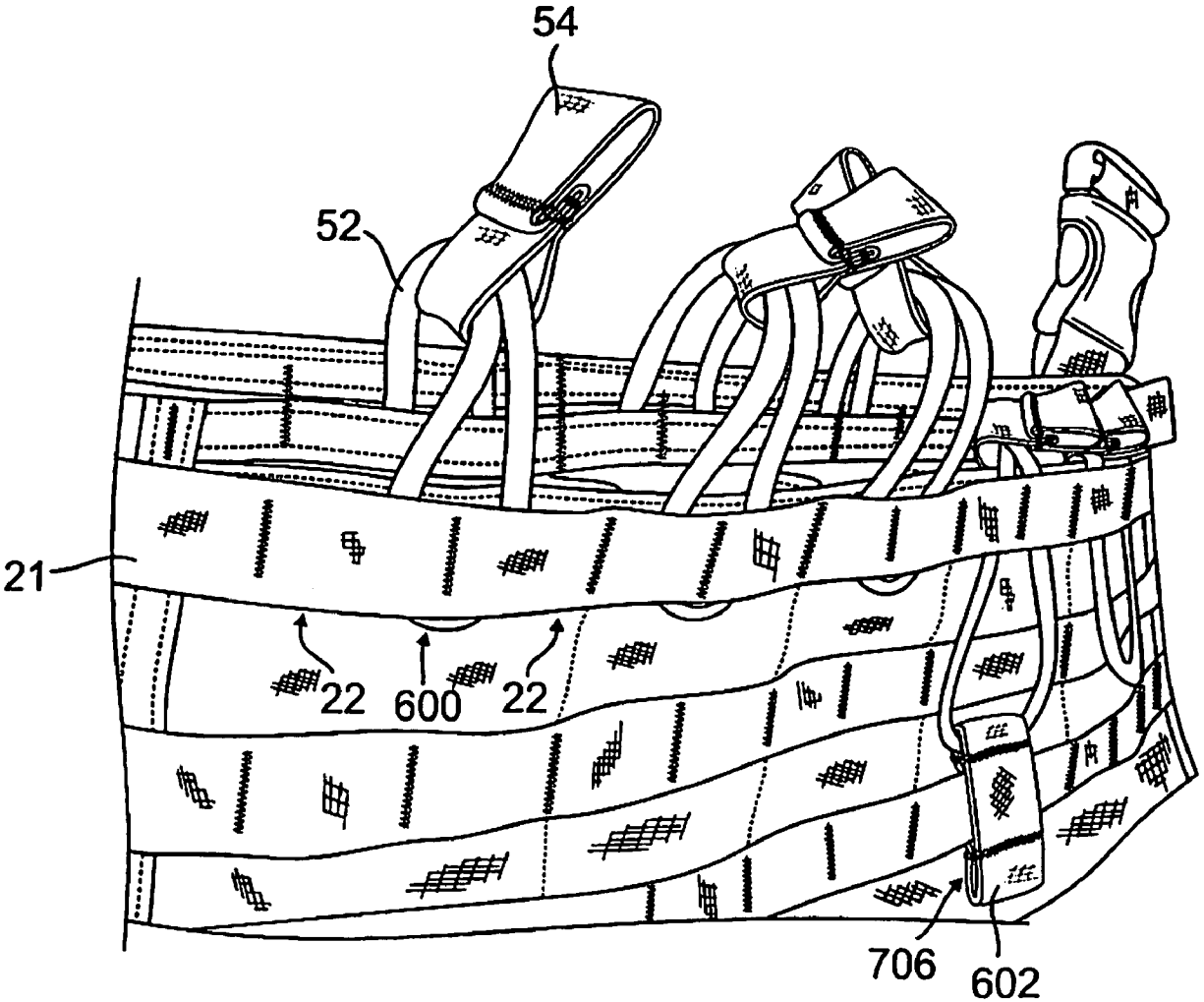
FIG. 6 is a close-up perspective view of the concealed magazine slot arrangement.
Figure 7A:
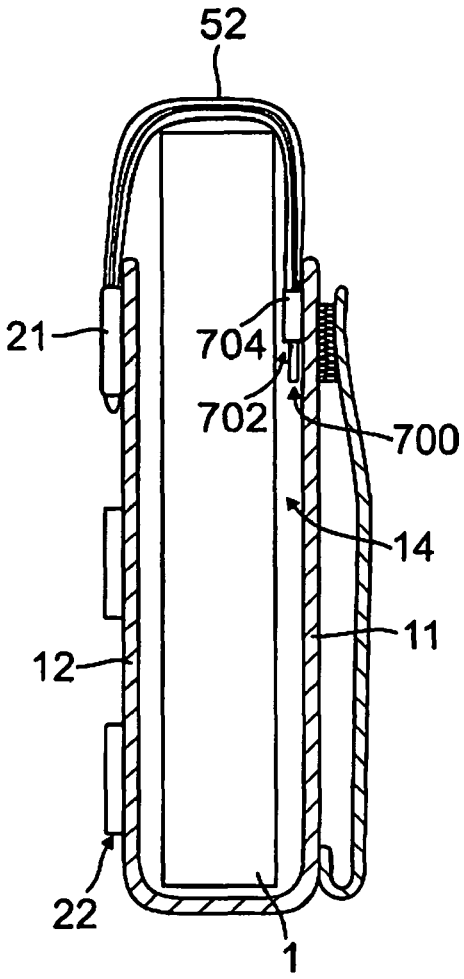
FIG. 7A is a sectional view of another embodiment of a quick accessing fastener of the concealed magazine slot arrangement.
Figure 7B:
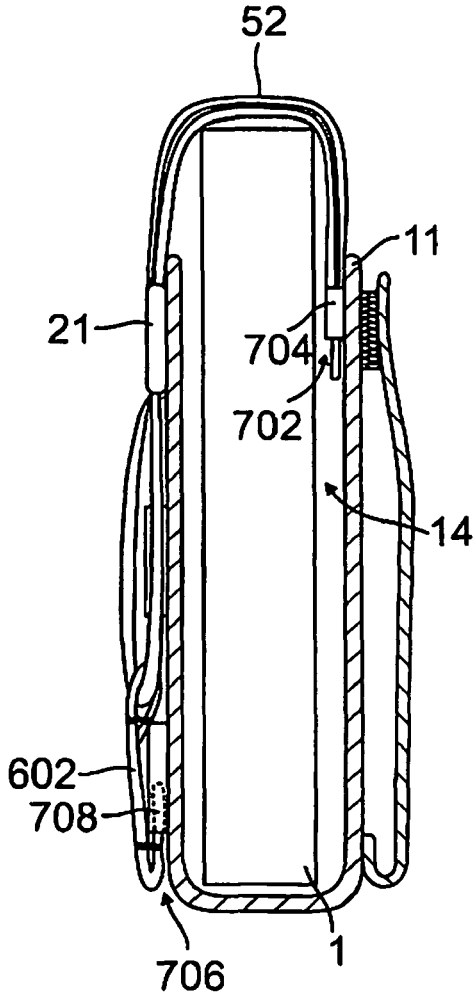
FIG. 7B is a sectional view of another embodiment of a quick accessing fastener of the concealed magazine slot arrangement.

In some embodiments, the elastic band 52 further comprises a quick release fastener 602 attached to the first portion 600 of the elastic band 52. The quick release fastener 602 may be a button, a buckle, a hook, a hook-and-loop, an interfering strap, or the like. An interfering strap as shown in FIGS. 6 and 7B may be an elongated piece of material, such as nylon, formed by folding a free end portion 706 over itself and sewing the free end portion 706 onto the interfering strap 602 leaving a free tab end 708 to be inserted into a gear slot 22. The quick release fastener 602 may be connected to the webbing straps 21 to adjust the tautness of the elastic band 52. The interfering strap has the advantage of being easily repaired on the field with a simple needle and thread. Any flat stiff piece of material, such as plastic, metal, wood, or the like, may be placed or secured adjacent to or inside the free tab end 708 to provide additional strength.

In some embodiments, the elastic band 52 may be attached to a pouch flaps 41G. The pouch flaps 41G may be releasably connected to the inner panel 11 and outer panel 12. For example, the pouch flaps 41G and the inner and outer panels 11, 12 may have hook-and-loop fasteners to detachably fasten to each other as shown in FIG. 3H. The opposing pouch flaps may be connected via the elastic band 52. Thus, the height or depth of the magazine slot 14 may be adjusted by adjusting the pouch flaps 41G and/or through the elasticity of the elastic band 52.

In use, as shown in FIG. 5, the elastic band may be moved to one side by pulling on the holding tab 54 to clear the opening to the magazine slot 14 and a magazine 1 may be inserted in the magazine slot 14. Releasing the elastic band 52 allows the elastic band 52 to recoil back into its natural position over the opening of the magazine slot 14 to prevent the magazine 1 from falling out. The first portion 600 of the elastic band 52 may be pulled down to create a downward biasing force on top of the magazine 1 as shown in FIG. 7B. The first portion of the elastic loop may also comprise a quick-release fastener 602 to secure the first portion 600 of the elastic loop 52 against the outer panel 12. The magazine may be placed in a ready position by allowing the magazine 1 to partially stick out of the magazine slot 14 by pulling the holding tab to one side and partially inserting the magazine 1 into the magazine slot 14 or partially removing the magazine 1 out of the magazine slot 14. The elastic loop may be released onto the side of the magazine 1 thereby creating a lateral biasing force to secure the magazine 1 against the magazine slot 14 in a partially exposed position as shown in FIG. 5. This allows quick access to the magazine 1 while still maintaining some security through resistive forces.

Figure 4:
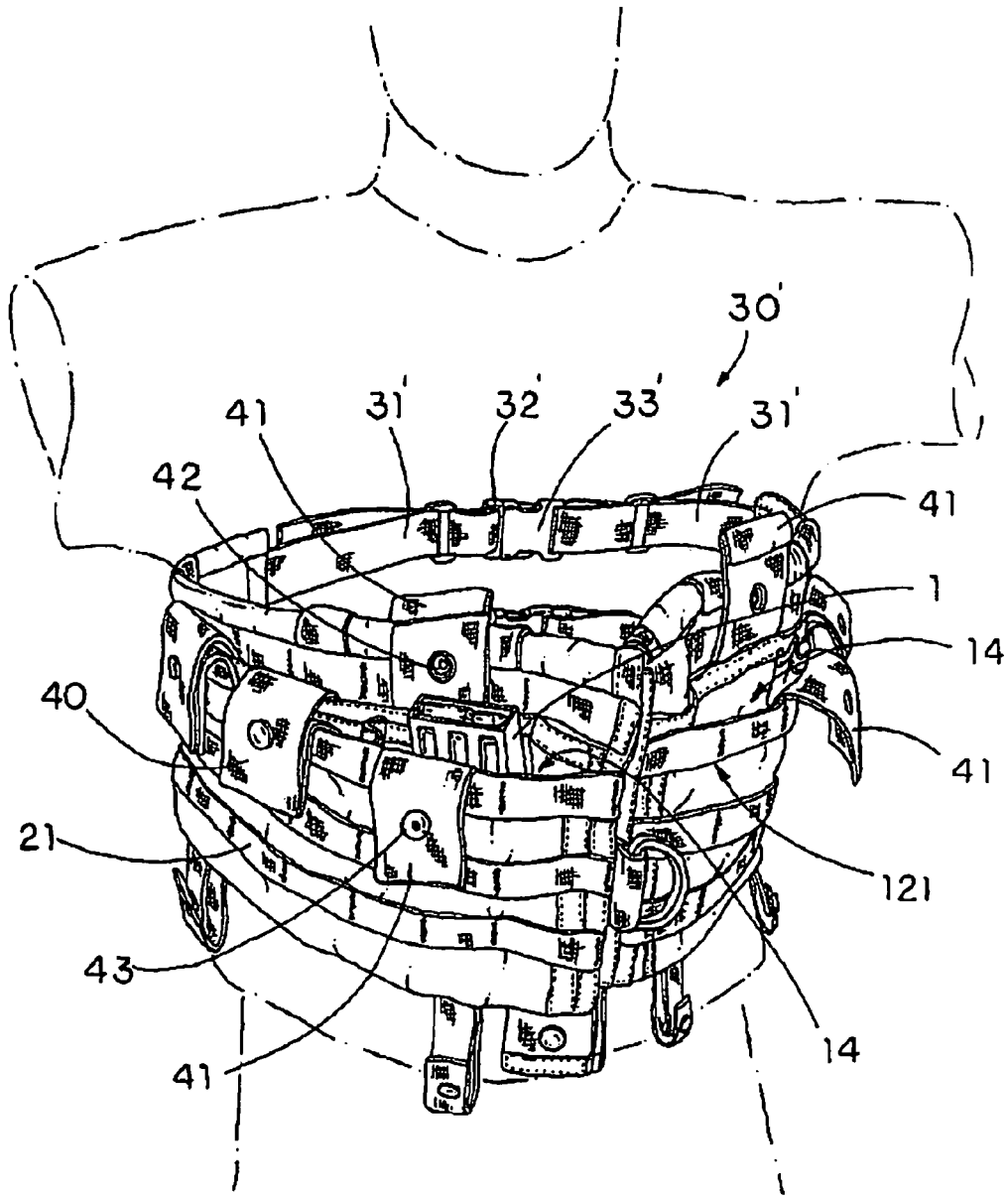
FIG. 4 is a perspective view of the concealed magazine slot arrangement as a chest harness or a midriff harness worn on the user's body according to the above preferred embodiment of the present invention.

FIG. 4 illustrates an alternative mode of the fastening means 30' wherein the concealed magazine slot arrangement serves as a chest harness or a midriff harness. As shown in FIG. 4, the fastening means 30' comprises at least two body straps 31' sidewardly extended from two sides of the magazine holder 10 respectively, and first and second connectors 32', 33' respectively provided at two free ends of the body straps 31' wherein the first and second connectors 32', 33' are detachably connected with each other for fastening the magazine holder 10 on the user's body. Accordingly, the first and second connectors 32', 33' are a buckle plug and a buckle socket such that the magazine holder 10 can be detachably fastened on the chest or midriff of the user.

As shown in FIG. 1, the magazine holder 10 further comprises a map pocket 15 formed on a rear side of the inner panel 11 wherein a pocket panel 151 is overlappedly affixed to the rear side of the inner panel 11 to define the map pocket 15 between the pocket panel 151 and the inner panel 11. It is worth to mention that since the rear side of the magazine holder 10 is wrapped to fit the curvature of the user's body, the map pocket is designed for carrying a map or other sheet like element such as paper instead of carrying a rigid element that the user may feel uncomfortable.

It is obvious that the map pocket 15 can be modified to be a pocket for carrying a bulletproof panel therein for safety purpose.

Figure 8:
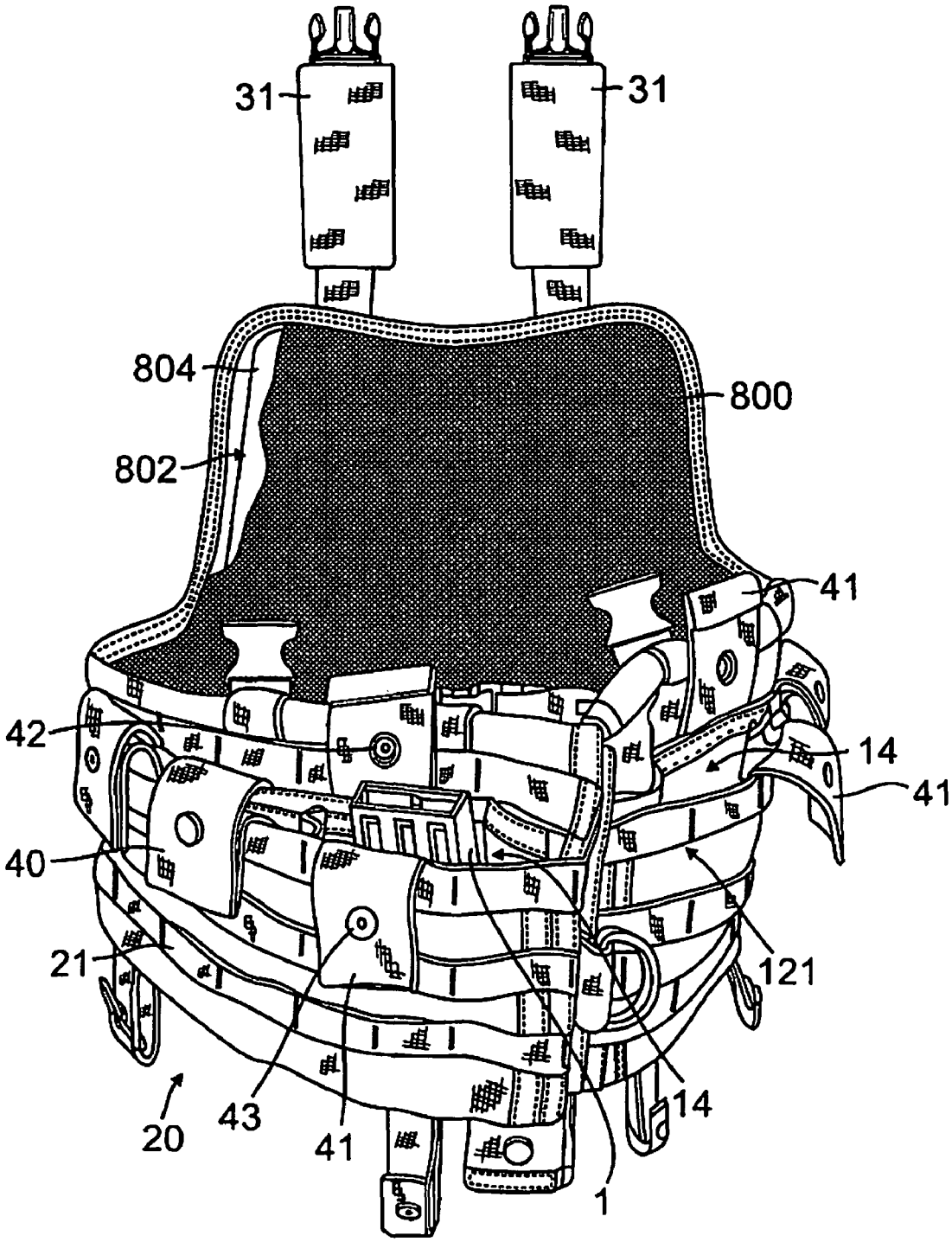
FIG. 8 is a perspective view of another embodiment of the present invention.

FIG. 8 shows another embodiment of the present invention comprising a back panel 800. The back panel 800 may be a continuation of the lateral portion of the gear carrier 20 towards the back to provide covering for the back. The back panel 800 may comprise a compartment 802 to hold additional gear or equipment. For example, the compartment 802 may hold a water bladder to provide fluids to the wearer. The compartment 802 may also hold a bulletproof panel for safety. The compartment may be accessible from the sides, the bottom, or the top. The compartment 802 may be securely closed by any quick-releasing fastener means, preferably, snap buttons or hook and loop type fasteners.

One skilled in the art will understand that the embodiment of the present invention as shown in the drawings and described above is exemplary only and not intended to be limiting.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A concealed magazine slot arrangement for carrying at least a magazine on a user's body, comprising:

a. a magazine holder comprising an inner panel, an outer panel, having a front operation side, overlapped on said inner panel, and a plurality of slot dividers transversely and spacedly affixed between said inner and outer panels to form a plurality of magazine slots concealed within said inner panel, said outer panel, and said slot dividers for receiving said magazine;

b. a gear carrier provided on said front operation side of said magazine holder for carrying a gear thereon, wherein said gear carrier comprises a plurality of webbing straps longitudinally formed on said front operation side of said magazine holder, wherein each of said webbing straps is spacedly sewn on said front operation side of said magazine holder with a stitching to form a plurality of gear slots for slidably receiving said gear therethrough;

c. a means for detachably fastening said magazine holder on said user's body, wherein said magazine holder when fastened is warped for fitting a curvature of said user's body, such that said outer panel is reinforced to substantially bias against said inner panel to physically self-adjust a shape of said magazine slots for retaining said magazine within said respective magazine slot of said magazine holder; and d. a means for adjustably securing said magazine within said magazine slot to accommodate magazines of various sizes, wherein said means for adjustably securing said magazine with said magazine slot comprises a quick accessing fastener for securely retaining said magazine within said respective magazine slot and for providing a quick access of said magazine to withdraw from said respective magazine slot, wherein said quick accessing fastener comprises an elastic band connected to said inner panel and said outer panel at an opening of each of said magazine slots for securely holding said magazine therein said elastic band being a closed elastic loop, comprising a first portion looped around the stitching between two adjacent gear slots on the front operation side of the magazine holder.

2. The concealed magazine slot arrangement of claim 1, wherein the quick accessing fastener further comprises a holding tab slidably positioned on the elastic band in between said first portion and said second portion.

3. The concealed magazine slot arrangement of claim 1, wherein said fastening means comprises a shoulder strap upwardly extended from said magazine holder and a waist strap sidewardly extended from said magazine holder such that said magazine holder serves as a vest for being worn on said user's body while said magazine slots are positioned at said chest of said user.

4. The concealed magazine slot arrangement of claim 1, wherein said fastening means comprises at least two body straps sidewardly extended from two sides of said magazine holder respectively, and first and second connectors respectively provided at two free ends of said body straps, wherein said first and second connectors are detachably connected with each other for fastening said magazine holder on said user's body.

5. The concealed magazine slot arrangement of claim 1, wherein the quick accessing fastener further comprises a quick release fastener.

6. The concealed magazine slot arrangement of claim 5, wherein the quick release fastener is an interfering strap.

* * * * *